US005556053A

United States Patent [19]

Henseler

[11] Patent Number: 5,556,053

[45] Date of Patent: Sep. 17, 1996

[54] WINDER FOR WINDING A TRAVELING PAPER WEB

[75] Inventor: Klaus Henseler, Titisee-Neustadt, Germany

[73] Assignee: Voith Sulzer Papiermaschinen GmbH, Heidenheim, Germany

[21] Appl. No.: 449,726

[22] Filed: May 24, 1995

[30] Foreign Application Priority Data

May 31, 1994 [DE] Germany ..... 44 18 900.1

[51] Int. Cl.[6] ..... B65H 18/20

[52] U.S. Cl. ..... 242/541.6; 242/542

[58] Field of Search ..... 242/541.3, 541.5, 242/541.6, 541.7, 542, 542.2, 547, 542.4

[56] References Cited

U.S. PATENT DOCUMENTS

| | | | |
|---|---|---|---|
| 2,461,387 | 2/1949 | Medbert . | |
| 3,497,151 | 2/1970 | Kennther . | |
| 5,335,871 | 8/1994 | Fissmann et al. | 242/542 |
| 5,464,169 | 11/1995 | Henseler et al. | 242/542 |

FOREIGN PATENT DOCUMENTS

| | | |
|---|---|---|
| 678585 | 7/1939 | Germany . |
| 8536VII | 10/1956 | Germany . |
| 2060757 | 6/1972 | Germany . |
| 2757247 | 7/1978 | Germany . |
| 7310606 | 10/1980 | Germany . |
| 9204667 | 9/1992 | Germany . |
| 4208790 | 9/1993 | Germany . |
| 3839244 | 12/1993 | Germany . |
| 4402624 | 6/1994 | Germany . |

*Primary Examiner*—John M. Jillions
*Attorney, Agent, or Firm*—Baker & Daniels

[57] ABSTRACT

A winder for winding a traveling paper web. Two king rolls form a winding bed for accommodation of a paper roll, and a revolving support belt loops around the paper roll on part of its circumference. The support belt is arranged between the two king rolls, and is backed by a backing element adapted to be forced on it. The support element features a support surface on which the support belt slides and whose radius is variable in accordance with the radius of the paper roll.

10 Claims, 3 Drawing Sheets

WINDER FOR WINDING A TRAVELING PAPER WEB

BACKGROUND OF THE INVENTION

The invention relates to a winder for winding a traveling web, wherein two king rolls form a winding bed for accommodating a paper roll. A revolving support belt loops around the paper roll, over part of its circumference.

In winding webs, the winding hardness is a significant factor for further processing. Particularly with paper webs it is very important for the winding hardness to have a specific progression across the entire paper roll diameter.

In general, the winding hardness should drop from a certain initial value to a final value. The drop should be maximally uniform from the first to the last layer. The drop should have a certain gradient, that is, should not be too heavy and not too light. The progression of the winding hardness should not at any rate include jumps, for instance a sudden drop. This can be accomplished only by specific measures. When letting things go, the line pressure between the paper roll and the king roll(s) becomes ever greater, and with it also the winding hardness.

A winder of this general type is known from DE 38 39 244. This winder features three king rolls. The first is stationary while the following two are movable and looped by a support belt. The support belt and the positional change of the second and third king roll serves to control the winding hardness across the entire paper roll diameter. The objective for the support belt is to provide a maximally large support surface in order to reduce the surface load. This winder is extremely expensive. In addition, it has a particularly grave disadvantage: once the paper roll has grown such that it is carried primarily by the support belt, strong vibrations may occur in the support belt, as a result of which the paper roll starts "dancing" and can be catapulted out of the winding bed.

Other measures for influencing the winding hardness are distributing the load of the paper roll among the individual king rolls. For that purpose, king rolls of equal diameter have been arranged already in different horizontal planes, or king rolls with different diameters were used. It is also known that winding on a king roll with a smaller diameter will produce a harder paper roll than winding on a king roll with a larger diameter.

Known from DE-DM 7 310 606 is a winder featuring two king rolls of equal size. One of them can during the winding operation be lowered from an upper position above the horizontal plane of the axis of the other king roll at the beginning of the winding operation. The objective of this lowering is to obtain a firmly wound core from the outset.

U.S. Pat. No. 2,461,387 describes a winder that includes two powered king rolls of different diameters. The one with the smaller diameter has a coating with a greater coefficient of friction and is powered at a higher speed than the other king roll, thereby exerting a tension on the outer layer of the web.

DE-OS 27 57 247 concerns a winder with king rolls of the same diameter. The winding hardness is controlled by variation of the mutual spacing of the king rolls.

DE-PS 678 585 describes a winder with two king rolls of which the first has a hard shell and the second a soft shell. The axes of the two rolls are situated in one and the same horizontal plane.

DE-A-44 02 624 shows and describes a winder where the space bounded by the king rolls and the paper roll is fashioned as a pressure-tight chamber with a port for compressed air. Air volume and air pressure can be controlled in keeping with the growing weight of the paper roll. However, this involves appreciable problems in sealing the pressure chamber.

The problem underlying the invention is therefore to configure a winder of this general type in such a way that a controlled winding hardness is achievable across the winding diameter, that the diameter of the individual paper roll can be chosen still greater than heretofore, without inviting the feared busting of the outer turns of the paper roll, and that—most of all—air inclusions between the paper roll layers will be avoided.

SUMMARY OF THE INVENTION

This problem is solved by the features of the present invention. In the present invention, the support belt is arranged between the two king rolls, and the support belt is backed by a support element adapted to be forced on it. The support element features a support surface on which slides the support belt, and whose radius is variable in accordance with the radius of the paper roll.

From the great number of winders with an immeasurable variety of individual features, the inventor has chosen the inventive combination of features. The inventor recognized that the two king rolls each possess a considerable mass that can vibrate while rotating, thereby impairing the winding result. Arranging, in consequence thereto, a support element between the two king rolls contributes appreciably to solving the problem. The support element is movable toward the support surface, but forms a relatively rigid and thus vibration-damping unit. Support belt and support element may be configured in the manner of a so-called shoe press, known as such in the paper machine field.

BRIEF DESCRIPTION OF THE DRAWINGS

The invention will be more fully explained with the aid of the drawings, wherein:

FIG. 3 shows the winder according to FIGS. 1 and 2, in an end phase in which the paper roll has reached its greatest diameter.

DETAILED DESCRIPTION OF THE INVENTION

Figure 1:
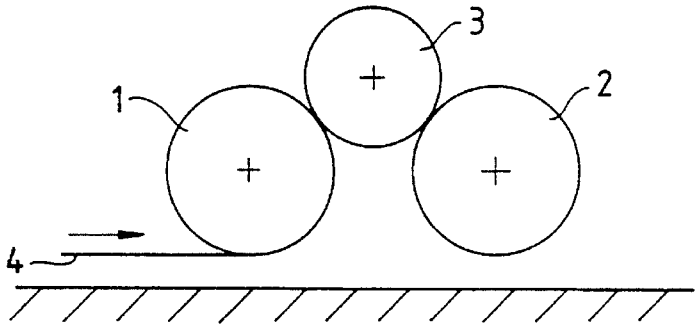
FIG. 1 shows schematically in simplified form a winder with a first and a second king roll, and a paper roll borne by the two king rolls.

FIG. 1 shows schematically in simplified form a winder with a first king roll 1, a second king roll 2 and a paper roll 3 borne by these two king rolls. The paper web 4 approaches from the left in the drawing. It runs thus from below onto the king roll 1, loops around it across a stretch of about 150° and proceeds then onto the paper roll 3. FIG. 1 shows the starting phase, during which the paper roll 3 still has a relatively small diameter.

Figure 2:
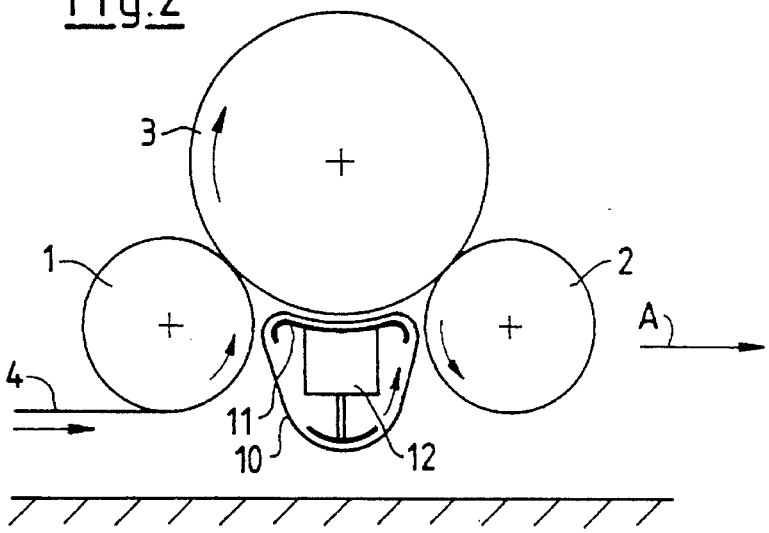

FIG. 2 shows a phase wherein the paper roll 3 has considerably grown in diameter. The two king rolls 1, 2 are movable relative to each other, in a way such that their mutual spacing is variable. Presently, the king roll 2 is movable in the direction of arrow A.

FIG. 2 also depicts a support unit comprised of a support belt 10, support element 11 and a power unit 12, with the support belt 10 sliding on the support element 11. Generally, a lubricant will be injected between the support surface of the support element 11 and the inside surface of the support belt 10. The support belt 10 may be provided with a drive of its own, but it is also conceivable that it is entrained by the rotating paper roll 3. Reference is made to the rotational arrows. The configuration of the support element 11 and the power unit 12 will be further addressed hereinafter.

The structure of the present winder is such that the entire support unit 10, 11 and 12 can after appropriate spreading of the king rolls 1, 2 retract into the space in between. The advantage of this is that support by the support unit can be provided at the decisive moment, namely once the paper roll 3 has reached a certain diameter.

Figure 3:
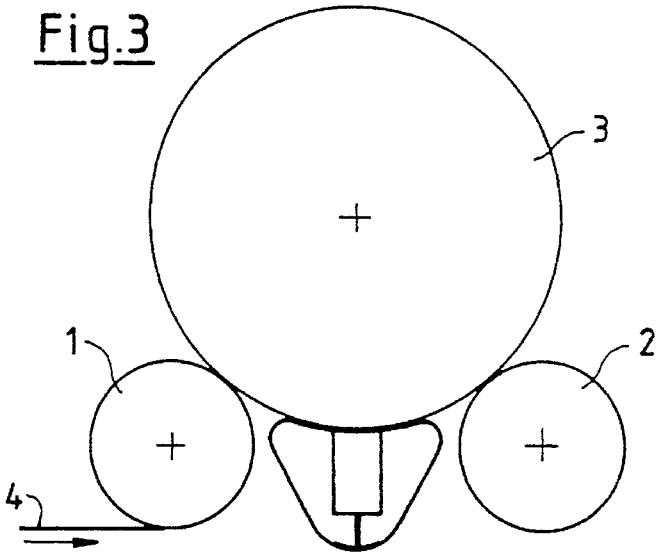
FIG. 3 shows a phase of a winding process, wherein the paper roll is of larger diameter, and a support unit having a support belt, support element and a power unit is shown.

FIG. 3 shows the winder according to FIG. 1 and 2, in an end phase in which the paper roll has reached its greatest diameter.

Figure 4:
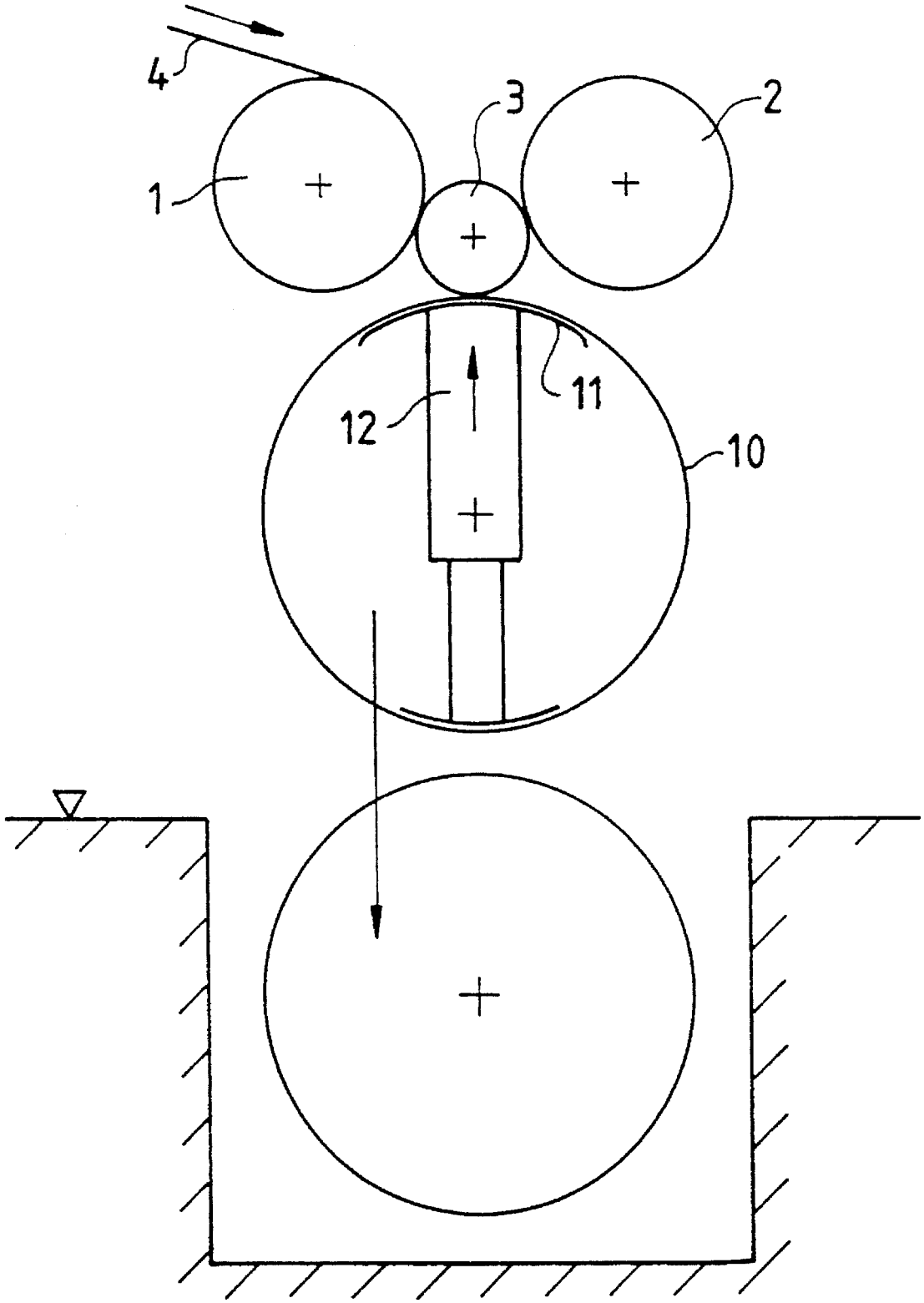
FIG. 4 shows another embodiment of a winder according to the present invention.

An alternative embodiment is illustrated in FIG. 4. Greatly simplified again, the upper part of the figure depicts schematically a winder with the king rolls 1 and 2, with the support unit comprised of support belt 10, support element 11 and power unit 12. This embodiment features the two following particulars:

The two king rolls 1, 2 are situated quite distinctly above the support unit 10, 11, 12. The longitudinal axes of the two king rolls 1, 2 are situated above the axis of the paper roll 3.

There is also the option of raising the two king rolls 1, 2 or lowering the support unit 10, 11, 12 as the paper roll 3 grows.

It is understood that raising the two king rolls 1, 2 need not proceed exactly vertically, but that it may include also a component of movement toward the two sides in the fashion of a mutual spacing. The support unit 10, 11, 12 may be lowerable into a floor recess. This option may serve to lower the support unit into the floor as the diameter of the paper roll 3 increases, such as indicated in the bottom part of FIG. 4.

Figure 5:
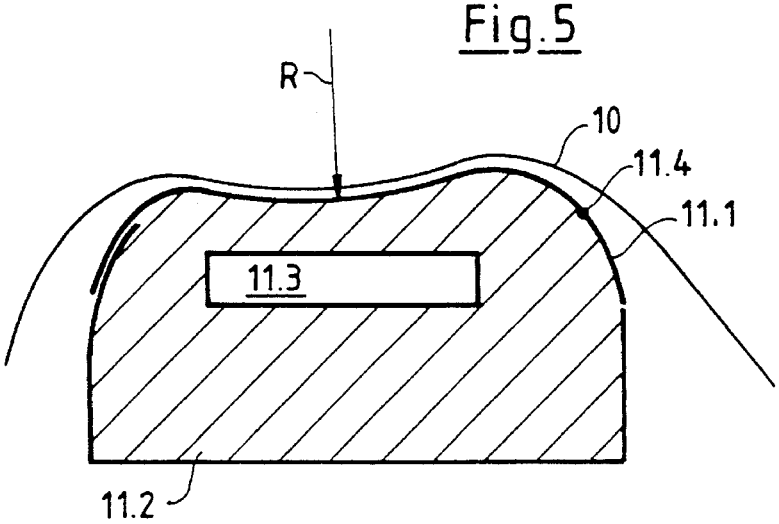
FIGS. 5 through 7 show alternative versions of the support unit.

FIG. 5 shows again the support belt 10 that makes direct contact with the last layer of the paper roll 3 (not illustrated here). In this case, the support element is formed of a flexible foil 11.1 and an elastomer support shoe 11.2. The latter encloses a pressure chamber 11.3 and features—not illustrated here—a port for introduction of a fluid medium, for instance air. The radius R of the support surface formed by the flexible foil 11.1 allows thus variable adjustment.

As can be seen furthermore, the flexible foil 11.1 attaches to the elastomer support shoe 11.2 at a fixed point 11.4, as shown at the right-hand part of the illustration. But the foil rests otherwise loosely on the outer contour of the elastomer pressure shoe, so that the foil allows deformation.

Figure 6:
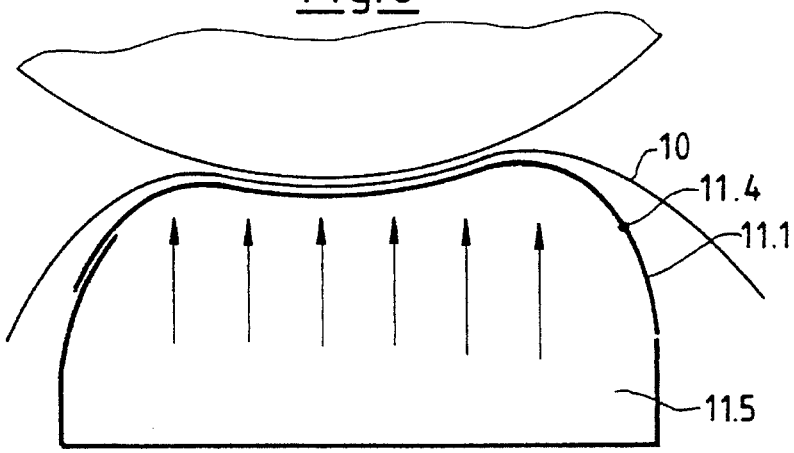

In the embodiment according to FIG. 6, the support element is formed of a fixed box 11.5 and of a flexible foil 11.1, the latter consisting, e.g., of plastic or metal. The foil is hinged to a wall of the box 11.5 by means of a hinge 11.4.

Figure 7:
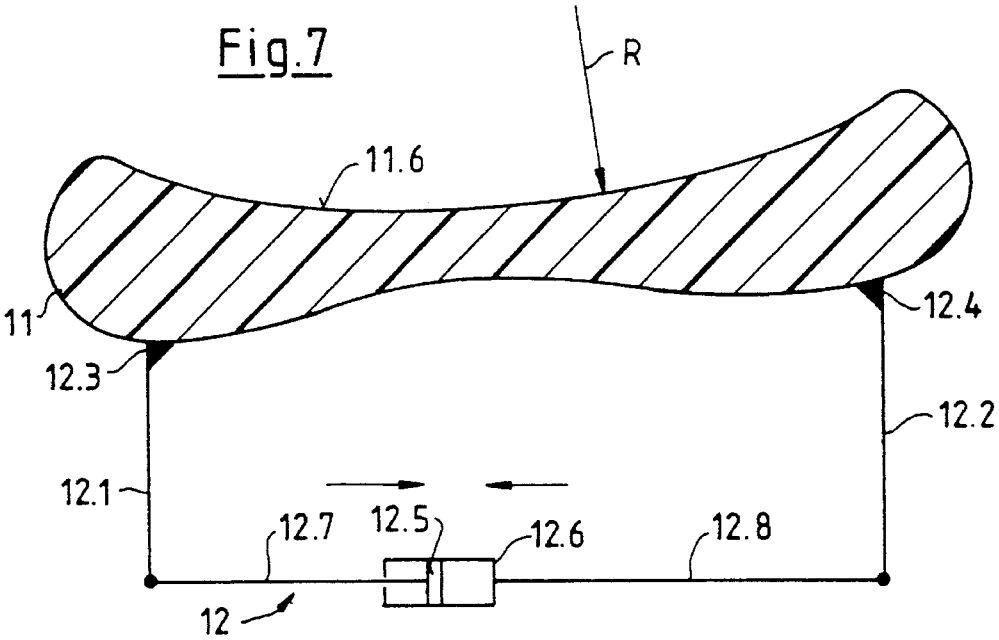

FIG. 7, scaled up, shows a support element 11 of a special kind. This particular embodiment consists of a material having properties equal or similar to hard rubber. Evident again is the radius R of the support surface 11.6 of the shoe.

The power unit 12 is presently comprised of two rigid levers 12.1, 12.2 joined rigidly to the support element 11 by way of rigid corners 12.3, 12.4. The two rigid corners 12.3, 12.4 are located in the two end areas of said support element 11. But their arrangement could as well be somewhat closer than illustrated here.

Visible, furthermore, are a piston 12.5 and a cylinder 12.6. Coordinated with these two elements are two rods 12.7, 12.8 that are hinged to the levers 12.1, 12.2. The power unit can be actuated by introduction of a pressure medium in the space of cylinder 12.6, either on the one or the other side of piston 12.5, so that the two levers 12.1, 12.2 will be acted upon accordingly by way of the joints. In turn, this causes a bending of the support element 11, either in the sense of enlarging or reducing the radius R, in accordance with the radius R of the paper roll, not illustrated here.

A very essential idea consists in fashioning the cross sectional profile illustrated here, of the support element 11, such that the support surface 11.6 proceeds steadily along a circular arc, since also the periphery of the paper roll is always circular. There are also other options to achieve just that, for instance by using appropriate packings of other material in the flesh of the support element. The principle applied is the same as in retaining rings (so-called Seger rings) that are known from the field of general mechanics.

It is understood that the longitudinal axes of both king rolls 1, 2 may both be situated in a horizontal plane and arranged at a mutual offset. A favorable embodiment provides for arranging one of the two king rolls, namely the one onto which runs the approaching paper web 4, with its upper apex below the upper apex of the other king roll 2. Also, the king roll 1 onto which the paper web runs has suitably a substantially softer shell than the other king roll 2.

What is claimed is:

1. A winder for winding a traveling paper web, comprising:

two king rolls arranged to form a winding bed for supporting a paper roll, the paper roll having a radius and a circumference;

a revolving support belt positioned and configured to loop around the paper roll over part of the circumference of the paper roll, the support belt being arranged between the two king rolls;

a support element arranged to be forcible on the support belt, the support element including a support surface arranged such that the support belt slides on said support surface during revolution of said support belt, said support surface having a radius, said radius being variable in accordance with the radius of the paper roll.

2. The winder of claim 1, further comprising a power unit for acting on the support element with a line force which, viewed in peripheral direction, has a progression adapted for selectively influencing the radius of the support surface.

3. The winder of claim 1, wherein the king rolls are mutually separated by a space, said space being variable, whereby a width of the winding bed for the paper roll is variable.

4. The winder of claim 1, wherein the paper web to be wound approaches one of the two king rolls from below.

5. The winder of claim 2, wherein the support belt, support element and power unit comprise a support unit, said support unit being selectively retractable and extendable from a space between the two king rolls.

6. The winder of claim 5, wherein the support unit is arranged so that said support unit is lowerable into a recess in a floor of a machine hall.

7. The winder of claim 1, wherein the support element includes an elastic support shoe, said elastic support shoe having an interior comprising a pressure chamber that extends across the width of the paper web and has a port for a pressure medium, and wherein the elastic support shoe is covered by a flexible foil that forms the support surface.

8. The winder of claim 1, wherein the support element comprises a rigid box, and wherein a flexible foil forms a lid of the box and comprises the support surface, said box including a port for introduction of a fluid medium.

9. The winder of claim 1, wherein the support element is bendable so that the radius of the support surface may be altered; a power unit for altering said radius of the support surface, the power unit being attachable to the support element at two points which, viewed in peripheral direction, are mutually spaced; the support element having a cross section such that the application of a traction or thrust force on the two points of attachment bends the support element, to form a circular arc contour of the support surface.

10. Winder for winding a traveling paper web, with two king rolls that form a winding bed for supporting a paper roll, with a revolving support belt that loops around the paper roll over part of its circumference, wherein the improvement comprises:

the support belt is arranged between the two king rolls;

the support belt is backed by a support element adapted to be forced on it; and the support element includes a support surface upon which slides the support belt, wherein the radius of the support surface is variable in accordance with the radius of the paper roll.

* * * * *